United States Patent [19]

Parker et al.

[11] 3,996,892

[45] Dec. 14, 1976

[54] SPATIALLY PROGRAMMABLE ELECTRODE-TYPE ROLL FOR ELECTROSTATOGRAPHIC PROCESSORS AND THE LIKE

[75] Inventors: Delmer G. Parker, Rochester; Joseph L. Scaletta, Henrietta, both of N.Y.

[73] Assignee: Xerox Corporation, Stamford, Conn.

[22] Filed: Feb. 24, 1975

[21] Appl. No.: 552,011

[52] U.S. Cl. ..... 118/658; 427/18

[51] Int. Cl.[2] ..... G03G 13/09

[58] Field of Search ..... 118/637; 427/18, 14; 355/3 DD

[56] References Cited

UNITED STATES PATENTS

| | | | |
|---|---|---|---|
| 2,987,037 | 6/1961 | Bolton | 118/637 |
| 3,257,224 | 6/1966 | Jöns et al. | 118/637 |
| 3,358,594 | 12/1967 | Thompson | 118/637 |
| 3,611,992 | 10/1971 | Lyles et al. | 118/637 |
| 3,759,222 | 9/1973 | Maksymiak et al. | 118/637 |
| 3,805,739 | 4/1974 | Feldeisen et al. | 118/637 |
| 3,818,864 | 6/1974 | Bickmore | 118/637 |
| 3,865,080 | 2/1975 | Hudson | 118/637 |
| 3,884,185 | 5/1975 | Liebman | 118/637 |

*Primary Examiner*—Mervin Stein

[57] ABSTRACT

A magnetic brush development system including a spatially programmable electrode-type applicator roll for developing latent electrostatic images carried by an imaging surface of an electrostatic processor as the imaging surface moves through a development zone which is subjected to a substantially stationary, locally generated electrostatic field having a generally uniform intensity widthwise of the imaging surface and a preselected, non-uniform intensity lengthwise of the imaging surface.

23 Claims, 4 Drawing Figures

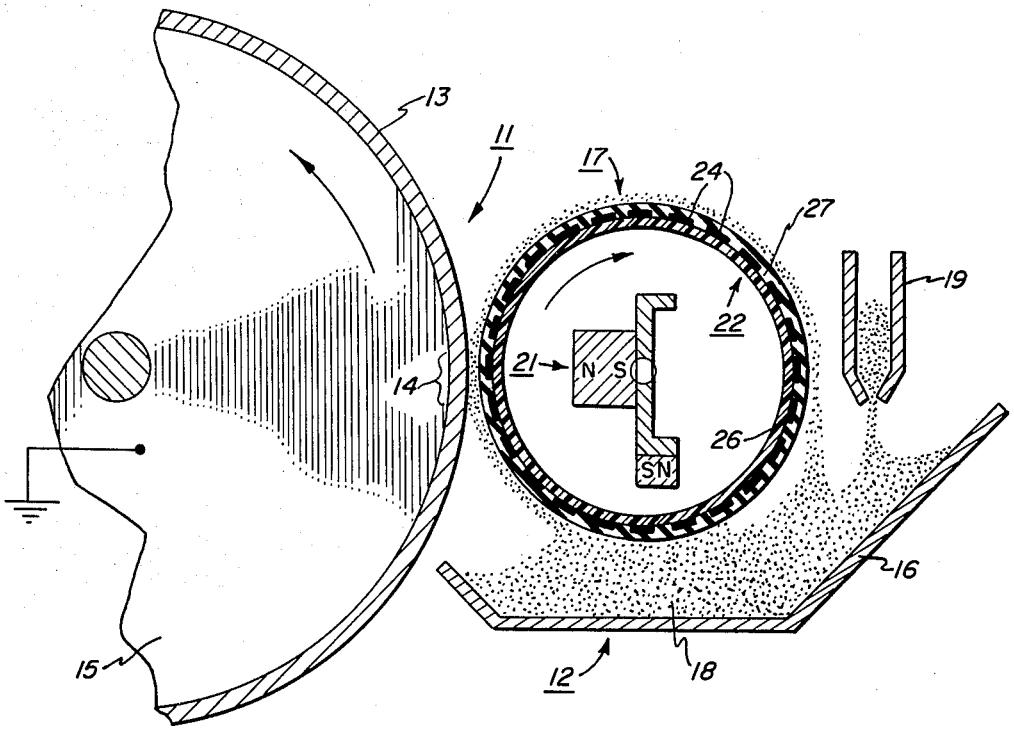
FIG. 1
FIG. 2
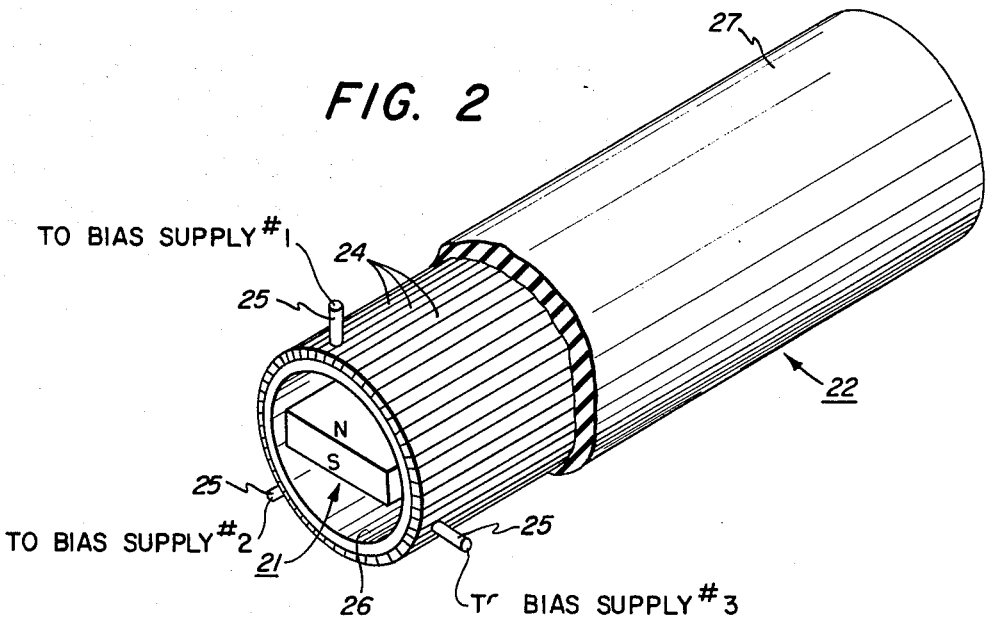

SPATIALLY PROGRAMMABLE ELECTRODE-TYPE ROLL FOR ELECTROSTATOGRAPHIC PROCESSORS AND THE LIKE

BACKGROUND OF THE INVENTION

This invention relates to spatially programmable electrode-type rolls for electrostatographic processors and the like and, more particularly, to magnetic brush development systems including spatially programmable electrode-type applicator rolls.

In a conventional electrostatographic printing process of the type described in Carlson's U.S. Pat. No. 2,297,691 on "Electrophotography", a uniformly charged imaging surface is selectively discharged in an image configuration to provide a latent electrostatic image which is then developed through the application of a finely divided coloring material, called "toner". As is known, that process may be carried out in either a transfer mode or a non-transfer mode. The non-transfer mode is characterized by the use of the imaging surface as the ultimate support for the printed image. In contrast, the transfer mode involves the additional steps of transferring the developed or toned image to a suitable substrate, such as plain paper, and then preparing the imaging surface for re-use by removing any residual toner particles still adhering thereto.

The Carlson patent specifically relates to xerography, which is probably the best example of the outstanding commercial success of electrostatography. Indeed, xerographic copiers and duplicators occupy an important position in todays business world. Xerography, of course, involves the use of a photoreceptor as the imaging surface, but there are other types of electrostatographic processors. For example, there are some wherein the imaging surface is a uniformly charged electrically insulating member which is selectively discharged non-photographically — e.g., by appropriately controlled stylii — to provide a latent electrostatic image which permits of subsequent processing in essentially the same manner as the photographically generated latent image of a xerographic processor. Moreover, it should be understood that xerographic and similar electrostatographic printing processes are not limited to use in stand alone copiers and duplicators. For instance, those processes have also been found to have utility in the facsimile art.

Electrostatographic processors conventionally rely on a multi-component developer comprising a mixture of toner particles and larger, so-called "carrier" particles. The materials for the toner and carrier (or, sometimes, carrier coating) components of the developer are selected so that they are removed from each other in the triboelectric series, whereby electrical charges of opposite polarities tend to be triboelectrically imparted to the toner and carrier particles. Furthermore, in making those selections, consideration is given to the triboelectric ranking of the materials to the end that the polarity of the charge nominally imparted to the toner particles opposes the polarity of the latent images which are to be developed. Thus, in operation, there are competing electrostatic forces acting on the toner particles of such a developer. Specifically, there are forces which at least initially attract them to the carrier particles. Additionally, the toner particles are subject to being electrostatically stripped from the carrier particles whenever they are brought into the immediate proximity of or actual contact with an imaging surface bearing a latent image.

Others have previously recognized that locally generated electrostatic fields may be advantageously utilized in electrostatographic processors to control or at least enhance the development, transfer and cleaning processes. Generically described, the imaging surface of such a processor is merely an electrically insulative layer having an electrically conductive backing. Thus, an electrostatic field may be generated simply by holding the backing for the imaging surface at one potential while maintaining an appropriately spaced electrode at another potential. Indeed, stationary electrodes are sometimes configured to generate relatively sophisticated fields. For example, there are development systems which include a stationary electrode having a plurality of electrically isolated segments so that individual segments of the electrode can be biased to different potentials relative to the backing for the imaging surface, thereby generating an electrostatic field which is tailored to accomplish several different functions, such as suppressing toner cloud emissions and reducing background development. Heretofore, however, rotating electrodes have not permitted of such sophistication. This is a serious shortcoming inasmuch as electrodes of that type are being widely utilized, especially in magnetic brush development systems.

SUMMARY OF THE INVENTION

Accordingly, an object of this invention is to provide a spatially programmable, rotatable electrode. A more detailed, related object is to provide a spatially programmable electrode-type roll which may be used in electrostatographic processors to generate a spatially tailored, substantially stationary electrostatic field.

More specifically, an object of the present invention is to provide a spatially programmable electrode-type applicator roll for magnetic brush development systems.

Briefly, to carry out these and other objects of the invention, there is provided an electrode comprising a roll which is mounted for rotation about a predetermined axis. The roll includes a plurality of axially extending elongated conductors which are carried by the roll at regular angular intervals about its axis of rotation. A plurality of stationary contacts are slidingly engaged with the conductors at spaced apart positions around the axis of rotation of the roll to vary the bias applied to the conductors as a function of the rotation of the roll. The invention is advantageously employed, for example, in magnetic brush development systems to provide the development zone of an electrostatographic processor with a substantially stationary electrostatic field which has a generally uniform intensity widthwise of the development zone and a preselected, non-uniform intensity lengthwise of the development zone. To that end, an applicator roll in such a system not only includes a stationary magnetic assembly which is supported within a non-magnetic rotatable sleeve in keeping with conventional practices, but also has axially extending elongated conductors carried by the sleeve and stationary contacts distributed around the sleeve as described hereinabove. Preferably, for that application, the sleeve and conductors are coated with a resistive medium which has a sufficiently high coefficient of friction to enable the sleeve to efficiently transport developer through the development zone. In that event, voltage gradients are set up in the resistive coating, thereby causing the electrostatic field to smoothly vary lengthwise of the development zone.

BRIEF DESCRIPTION OF THE DRAWINGS

Still further objects and advantages of this invention will become apparent when the following detailed description is read in conjunction with the attached drawings, in which:

FIG. 1 is a simplified sectional view of a magnetic brush development system including an applicator roll constructed in accordance with this invention;

FIG. 2 is an isometric view of the applicator roll, with part of the surface coating thereof being cut away to provide increased clarity;

DETAILED DESCRIPTION OF THE ILLUSTRATED EMBODIMENTS

Figure 3:
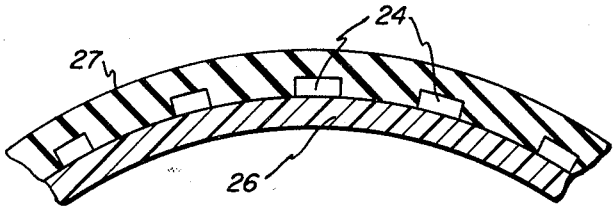
FIG. 3 is a fragmentary, sectional view of the applicator roll of FIG. 2.

While the invention is described in some detail hereinafter with reference to certain illustrated embodiments, it should be understood that there is no intent to limit it to those embodiments. On the contrary, the aim is to cover all alternatives, modifications, and specifications falling within the spirit and scope of the invention as defined by the appended claims.

Turning now to the drawings, and at this point especially to FIG. 1, there is shown an electrostatographic processor 11 (shown only in relevant part) having a magnetic brush development system 12 for developing latent electrostatic images carried by an electrically insulative imaging surface 13 on the fly — viz., as the imaging surface 13 moves through a development zone 14. Here, the imaging surface 13 is a photoconductive layer which is coated on an electrically conductive, rotatably driven drum 15 which, in turn, is held at a predetermined reference potential, such as ground. In other words, the processor 11 is a more or less conventional drum-type xerographic copier or the like.

In keeping with generally accepted practices, the magnetic brush development system 12 has a housing 16 for supporting at least one applicator roll 17 adjacent the development zone 14. The applicator roll 17 is spaced a predetermined, short distance from the imaging surface 13 and is rotatably driven (by means not shown) to brush developer against the imaging surface 13 as it moves through the development zone 14. The developer which is conventionally a mixture of triboelectrically charged toner and ferro-magnetic carrier particles, circulates in a path which runs from a sump 18 in the lower reaches of the housing 15, through the development zone 14, and then back to the sump 18. Some toner is necessarily consumed in the development process and, therefore, there usually is a toner dispenser 19 for adding additional toner to the developer mixture from time-to-time so that its toner concentration remains at a suitably high level.

One of the main purposes of the applicator roll 17 is to transport developer into and through the development zone 14 under the influence of a magnetic field which is shaped to cause the developer to form into bristle-like streamers which brush against the imaging surface 13. Those bristles or streamers are pronounced only in a relatively narrow region which is (hereinafter, referred to as the "nip" region) more or less centered on the line along which the roll 17 makes its closest approach to the imaging surface 13. However, the applicator 17 carries magnetically entrained developer from a pick-up point located upstream of the nip region to a discharge point located downstream of the nip region. To accomplish that, the applicator roll 17 customarily comprises a stationary permanent magnet assembly 21 which is supported within a cylindrical, non-magnetic sleeve 22 which, in turn, is mounted for rotation about an axis extending widthwise of and substantially parallel to the imaging surface 13.

Referring additionally to FIGS. 2 and 3, in accordance with the present invention, the applicator roll 17 is also a spatially programmable, rotatable electrode for subjecting the development zone 14 to a substantially stationary, locally generated electrostatic field having a substantially uniform intensity widthwise of the imaging surface 13 and a preselected, non-uniform intensity lengthwise of the imaging surface 13. The other electrode which participates in generating that field is, of course, the drum 15 (i.e., the electrically conductive backing for the imaging surface 13).

To carry out the invention, the sleeve 22 carries a plurality of axially extending, elongated conductors 24 at regular angular intervals about its axis of rotation, and there are a plurality of stationary contacts 25 slidingly coupled to the conductors 24 at spaced apart points around the axis of rotation of the sleeve 22. The contacts 25, or at least several of them, lead to different bias voltage supplies (not shown) and, therefore, the bias voltages applied to the conductors 24 varies as a function of the rotation of the sleeve 22. Of course, one or more of the contacts 25 may be floating if desired. The sleeve 22 comprises an electrically insulative core 26 for supporting the conductors and is preferably coated with a substantially homogeneous and uniformly thick resistive medium 27 having a sufficiently high coefficient of friction to enable the sleeve 22 to efficiently transport the developer. As a general guideline, a 1–25 mil thick coating of conductive rubber doped with carbon black to produce a restivity of $10^7$ – $10^9$ ohm·cm will prove satisfactory not only in terms of the coefficient of friction provided, but also in terms of providing a path for the neutralizing currents needed to neutralize the overall charge of the developer when toner particles are stripped therefrom. A suitable conductive rubber is "Kraton 4119" (supplied by Shell Chemical Company, a Division of Shell Oil Company), and a suitable carbon black is "Neospectra" (supplied by Columbian Carbon Company, a Division of City Service).

Typically, the insulative core 26 of the sleeve 22 is a NEMA grade XXX, phenolic resin, paper base tube. The conductors 24 may be formed by subjecting such a tube to a standard copper cladding process followed by a conventional photoresist-type etching technique, and the resistive medium 27 may then be applied by using a known spray coating treatment. In operation, of course, each of the conductors 24 is basically an equipotential surface, but a voltage drop determined by the bias voltages applied to adjacent ones of the conductors 24 is impressed across the intervening portion of the resistive medium 27. Accordingly, the interval or spacing between the adjacent conductors 24 must be selected so that there is no risk of arcing therebetween or of damagingly high localized heating of the resistive medium 27 under the worse case conditions as determined by the largest voltage drop likely to occur between the adjacent conductors 24.

Figure 4:
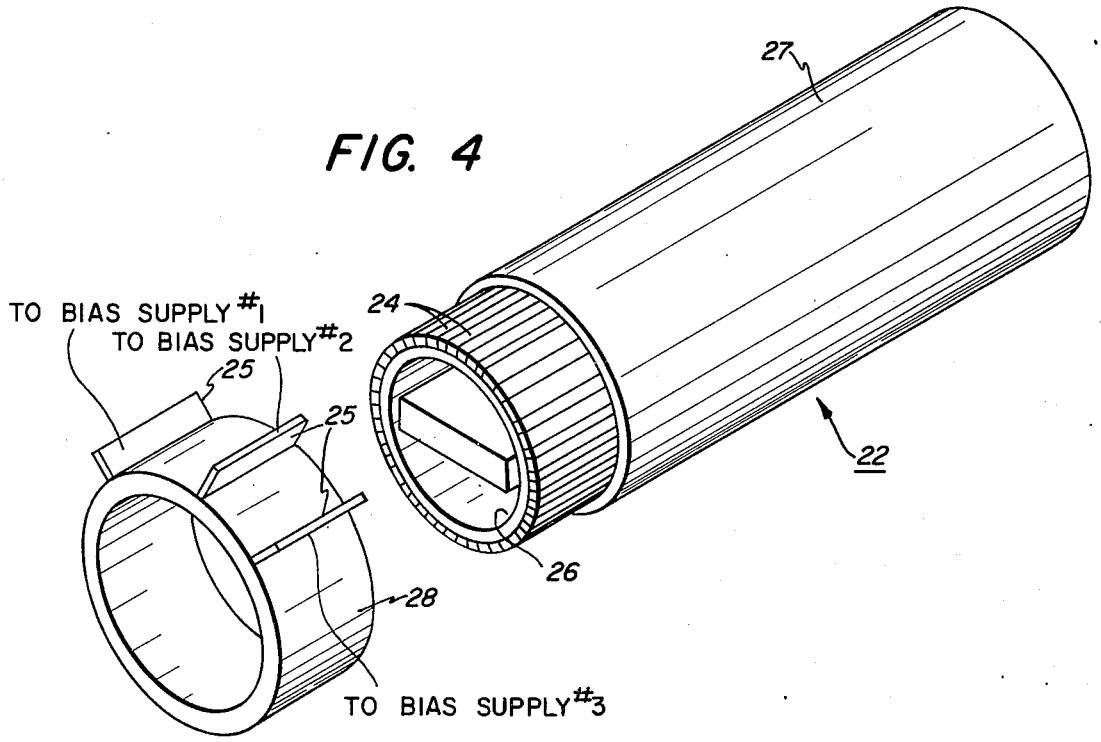
FIG. 4 is a fragmentary, exploded view of the applicator roll in combination with a resistive ring-like interface for coupling the contacts to the conductors.

A portion of each of the conductors 24 is free of the resistive coating 27 to permit the contacts 25 to be coupled thereto. As best shown in FIG. 2, the contacts 25 may ride directly on the surface of the coating-free portions of the conductors 24. In that event, each of the contacts 25 preferably has a span exceeding the interval or space between adjacent ones of the conductors 24 so that each of the contacts is always engaged with at least one of the conductors. Alternatively, as shown in FIG. 4, the contacts 25 may ride on a ring-like resistive member 28 which, in turn, is seated on the coating-free portions of the conductors 24 and mounted for rotation with the sleeve 22. In that case, the ring-like member 28 should be substantially homogeneous and preferably has a relatively low resistivity so that the bias voltages applied to the conductors 24 are established substantially independently of the coating 27.

As will be appreciated, the positioning of the contacts 25 and the voltages applied thereto largely determine the electrostatic field pattern lengthwise of the imaging surface 13. If it is assumed that the latent images divide the imaging surface 13 into image and background areas having nominal potentials of about 800 and 200 volts, respectively, desirable bias voltages levels for the conductors 24 can be identified for the pre-nip, nip, and post-nip regions of the development zone 14. Specifically, the conductors in the nip region at any given time are desirably biased to about 250–300 volts so that background development is inhibited, without materially interfering with the development of the latent images. Further, the conductors rotating through the upstream or pre-nip region are advantageously biased to a voltage of 100 volts or so, thereby urging the toner outwardly from the sleeve 22 to counter the tendency for the toner to migrate inwardly thereon which, in turn, is sometimes responsible for so-called "edge" development defects. Additionally, the conductors rotating through the downstream or post-nip region of the development zone 14 may be biased to a voltage of approximately 1000 volts, whereby toner particles are attracted to the sleeve 22, thereby suppressing undesirable toner or powder cloud emissions. As will be apparent, the bias voltages applied to the conductors 24 do not abruptly change from region-to-region. Instead the change in the bias voltages and, therefore, the change in the resultant field is gradual and smooth because of the voltage gradients produced in the resistive medium 27. Additionally, it will be evident that the bias voltages applied to the conductors 24 are more or less spatially fixed, even though the voltage on any one of them varies as a function of the rotation of the sleeve 22.

CONCLUSION

In view of the foregoing, it will now be understood that the present invention provides a spatially programmable electrode-type roll. The roll may be advantageously employed as an applicator roll for a magnetic brush development system, but is is not limited thereto. For example, the principles of this invention are also applicable to the roll-type transfer systems which are sometimes used in electrostatographic processors.

As shown, the development system operates in a so-called "with" mode (i.e., the drum 15 and the applicator roll 17 rotating in opposite directions). It will, however, be understood that such a system may also operate in an "against" mode.

What is claimed is:

1. In an electrostatographic processor having an electrically insulative imaging surface overlying an electrically conductive backing, and means for holding said backing at a predetermined reference potential; the improvement comprising a rotatable electrode positioned a predetermined distance from said imaging surface and in opposing relationship with respect to said backing for generating a substantially stationary electrostatic field across said surface, said field having an essentially uniform intensity widthwise of said imaging surface and a non-uniform but controlled intensity lengthwise of said surface; said electrode including a body mounted for rotation on an axis running widthwise of and substantially parallel to said imaging surface, said body comprising a resistive medium and a plurality of elongated axially extending conductors engaged with said resistive medium at regular angular intervals about said axis;

biasing supplies for providing different fixed bias voltages; and a plurality of stationary contacts associated with said supplies and located at spaced apart positions about said axis for slideably coupling said bias supplies to the conductors rotating past said positions, whereby spatially fixed bias voltages are applied to said conductors to create spatially fixed voltage gradients in said resistive medium.

2. The improvement of claim 1 wherein said contacts ride on mutually exclusive conductors, and each of said contacts has a span exceeding the interval between adjacent ones of said conductors, whereby each contact is always engaged with at least one conductor.

3. The improvement of claim 1 further including a resistive member interposed between said contacts and said conductors, said resistive member being mounted for rotation with said body is sliding engagement with said contacts.

4. The improvement of claim 1 wherein said body further includes an electrically insulative support for said conductors, said resistive medium is a substantially homogeneous and uniformly thick surface coating overlying said support and said conductors, and each of said condutors has an uncoated portion available for coupling to said contacts.

5. The improvement of claim 4 wherein the uncoated portions of said conductors are exposed, said contacts ride on the exposed portions of mutually exclusive contacts, and each of said contacts has a span exceeding the interval between adjacent ones of said conductors, whereby each contact is always engaged with at least one conductor.

6. The improvement of claim 4 further including a resistive coupling member interposed between said contacts and the uncoated portions of said conductors, said coupling being mounted for rotation with said body in sliding engagement with said contacts.

7. The improvement of claim 6 wherein said resistive medium has a predetermined resistivity, and said resistive coupling member is substantially homogeneous and has a substantially lower resistivity than said resistive medium.

8. In a magnetic brush development system for developing latent electrostatic images carried by an electrically insulative imaging surface having an electrically conductive backing which is held at a predetermined reference potential; said system including a sump for storing a supply of ferromagnetic developer, and means for circulating developer along a predetermined path running from said sump, through said development zone, and then back to said sump; the improvement in said means comprising an applicator roll including a non-magnetic sleeve spaced a predetermined distance from said imaging surface adjacent said development zone, said sleeve being mounted for rotation about an axis extending widthwise of and substantially parallel to said imaging surface;

a stationary magnetic means supported within said sleeve for supplying a magnetic field shaped to magnetically entrain developer on said sleeve while the developer is being transported by said sleeve through pre-nip, nip, and post-nip regions of said development zone, the shape of said magnetic field being selected to cause the developer in the nip region of said development zone to form bristle-like streamers extending outwardly from said sleeve to brush against said imaging surface;

a plurality of axially extending elongated conductors carried by said sleeve at regular angular intervals about said axis; and a plurality of stationary contacts located in fixed, spaced apart positions about said axis for applying different bias voltages to said conductors, said contacts being slidingly coupled to said conductors, whereby the bias voltages applied to said conductors vary as a function of rotation of said sleeve, thereby generating between said conductors and said backing a substantially stationary electrostatic field having a generally uniform intensity widthwise of said imaging surface and a pre-selected non-uniform intensity lengthwise of said imaging surface.

9. The improvement of claim 8 wherein said sleeve has a substantially homogeneous and uniformly thick resistive coating having a predetermined resistivity, whereby voltage gradients are generated in said coating between adjacent pairs of said conductors, thereby causing the intensity of said electrostatic field to smoothly vary lengthwise of said imaging surface.

10. The improvement of claim 9 wherein a portion of each of said conductors is free of said coating, said contacts ride on the coating-free portions of mutually exclusive ones of said conductors, and each of said contacts has a span exceeding the interval between adjacent ones of said conductors, whereby each of said contacts is always engaged with at least one of said conductors.

11. The improvement of claim 10 wherein said imaging surface has a charge of a predetermined polarity, said latent images divide said imaging surface into image areas having a relatively high potential and background areas having a relatively low potential, said developer comprises ferromagnetic carrier particles carrying a charge of said predetermined polarity and toner particles carrying a charge of the opposite polarity, and said bias voltages are selected to bias the conductors rotating past the nip region of said development zone to a potential between the potentials of said image and background areas, whereby the electrostatic field in said nip region inhibits toner particles from depositing on said background areas while still permitting the toner particles to deposit on said image area.

12. The improvement of claim 11 wherein said bias voltages are also selected to bias the conductors rotating past the pre-nip region of said development zone to a lower potential than said background areas, whereby the electrostatic field in said pre-nip region urges said toner particles outwardly from said sleeve.

13. The improvement of claim 12 wherein said sleeve comprises an electrically insulative core for supporting said conductors, and said resistive medium is a conductive rubber coating which overlies said core and said conductors except in the proximity of the coating-free portions of said conductors.

14. The improvement of claim 11 wherein said bias voltages are also selected to bias the conductors rotating past the post-nip region of said development zone to a higher potential than said image areas, whereby the electrostatic field in said post-nip region urges toner particles inwardly toward said sleeve to suppress toner cloud emissions.

15. The improvement of claim 14 wherein said sleeve comprises an electrically insulative core for supporting said conductors, and said resistive medium is a conductive rubber coating which overlies said core and said conductors except in the proximity of the coating-free portions of said conductors.

16. The improvement of claim 14 wherein said bias voltages are also selected to bias the conductors rotating past the pre-nip region of said development zone to a lower potential than said background areas, whereby the electrostatic field in said pre-nip region urges said toner particles outwardly from said sleeve.

17. The improvement of claim 14 wherein a portion of each of said conductors is free of said coating, and further including a relatively low resistivity coupling member interposed between said contacts and the coating-free portion of said conductors for applying said bias voltages to said conductors, said coupling member being mounted for rotation with said sleeve and being slidingly engaged with said contacts.

18. The improvement of claim 17 wherein said imaging surface has a charge of a predetermined polarity, said latent images divide said imaging surface into image areas having a relatively high potential and background areas having a relatively low potential, said developer comprises ferromagnetic carrier particles carrying a charge of said predetermined polarity and toner particles carrying a charge of the opposite polarity, and said bias voltages are selected to bias the conductors rotating past the nip region of said development zone to a potential between the potentials of said image and background areas, whereby the electrostatic field in said nip region inhibits toner particles from depositing on said background areas while still permitting the toner particles to deposit on said image areas.

19. The improvement of claim 18 wherein said bias voltages are also selected to bias the conductors rotating past the pre-nip region of said development zone to a lower potential than said background areas, whereby the electrostatic field in said pre-nip region urges said toner particles outwardly from said sleeve.

20. The improvement of claim 19 wherein said sleeve comprises an electrically insulative core for supporting said conductors, and said resistive medium is a conductive rubber coating which overlies said core and said conductors except in the proximity of the coating-free portions of said conductors.

21. The improvement of claim 18 wherein said bias voltages are also selected to bias the conductors rotating past the post-nip region of said development zone to a higher potential than said image areas, whereby the electrostatic field in said post-nip region urges toner particles inwardly toward said sleeve to suppress toner cloud emissions.

22. The improvement of claim 21 wherein said sleeve comprises an electrically insulative core for supporting said conductors, and said resistive medium is a conductive rubber coating which overlies said core and said conductors except in the proximity of the coating-free portions of said conductors.

23. The improvement of claim 22 wherein said bias voltages are also selected to bias the conductors rotating past the pre-nip region of said development zone to a lower potential than said background areas, whereby the electrostatic field in said pre-nip region urges said toner particles outwardly from said sleeve.

* * * * *